US006067831A

United States Patent [19]

Amborn et al.

[11] Patent Number: 6,067,831

[45] Date of Patent: May 30, 2000

[54] HYDROFORMING PROCESS

[75] Inventors: Peter Amborn, In den Garten 2, D-53819 Neunkirchen, Germany; Alexander Mark Duff, Telford, United Kingdom

[73] Assignees: GKN Sankey, United Kingdom; Peter Amborn, Germany

[21] Appl. No.: 09/219,051

[22] Filed: Dec. 23, 1998

[51] Int. Cl.[7] ..... B21D 26/02

[52] U.S. Cl. ..... 72/58; 72/709; 29/421.1

[58] Field of Search ..... 72/57, 58, 709; 29/421.1

[56] References Cited

U.S. PATENT DOCUMENTS 3,340,101 9/1967 Fields et al. ..... 72/58

3,896,648 7/1975 Schertenleib ..... 72/61

5,214,948 6/1993 Sanders et al. ..... 72/58

5,649,439 7/1997 Schultz ..... 72/709

*Primary Examiner*—David Jones

*Attorney, Agent, or Firm*—Jones & Askew

[57] ABSTRACT

A hydroforming process for forming a component from an elongate tubular blank comprised of a deformable metal, the process including placing the blank in a die and sealing opposed ends of the tubular blank, heating the blank to a predetermined deformation temperature which is greater than 350° C. but less than the melting point of the metal, supplying a gas at a predetermined pressure to the interior of the sealed tubular blank to cause deformation of said tubular blank at predetermined regions by drawing/stretching of the metal.

23 Claims, 3 Drawing Sheets

GRAPH A

GRAPH B

HYDROFORMING PROCESS

The present invention relates to a fluidforming process.

In the present specification, the term fluidforming relates to the general process of deforming a material, usually in the form of a tubular blank, by the application of fluid pressure; the fluid may be a liquid, a gas or a fluidised solid eg. solid particles which collectively act as a fluid.

A fluidforming process using a liquid as the pressurised fluid is referred to herein as hydroforming.

The present invention is particularly, but not exclusively, concerned with a fluidforming process for producing metal tubular structural components for use in the construction of motor vehicles.

Such structural components are usually produced by a hydroforming process involving placing a metal tubular blank into a die having the required shape of the finished tubular component and supplying a pressurised liquid internally of the blank to form it radially outwardly in order to take up the shape determined by the die.

In the hydroforming process it is also known to apply opposed axial compressive forces to the opposite axial ends of the blank at the same time as applying the pressurised liquid in order to assist the material of the blank to flow to greater radial distances. However, friction between the tubular blank and the die tends to restrict this assistance to regions located adjacent to the ends of the tubular component.

It has been appreciated that performing the hydroforming process at elevated temperatures has the advantage of facilitating material flow and so various proposals have been developed for performing the hydroforming process at elevated temperatures.

These prior proposals require the use of specially formulated liquids and usually require substantial modification to the die construction in order to enable the die to operate safely at the elevated temperatures.

In addition there is a practical limit to the maximum temperature which can be attained when using a liquid as the pressurised fluid. Generally, this maximum temperature is about 350° C. when using specially formulated liquids in the form of oils.

Similarly fluidforming processes utilising fluidised solids as the pressurised fluid operating at elevated temperatures are known but again complicate the die construction.

A general aim of the present invention is to provide a fluidforming process which can perform at elevated temperatures in excess of about 350° C. without requiring substantial modification of the die in order to operate safely at the elevated temperature.

According to one aspect of the present invention there is provided a fluidforming process for forming a component from an elongate tubular blank comprised of a deformable metal, the process including placing the blank in a die and sealing opposed ends of the tubular blank, heating the blank to a predetermined deformation temperature which is greater than 350° C. but less than the melting point of the metal, supplying a gas at a predetermined pressure to the interior of the sealed tubular blank to cause deformation of said tubular blank by drawing/stretching of the metal.

Certain metals, usually referred to as superplastic metals, become super plastic at elevated temperatures, typically 0.6–0.7 $T_m$ (where $T_m$ is the melting point of the metal). The temperature at which such metals become super plastic is referred to herein as the super plastic temperature of the metal. If the metal from which the tubular blank is formed is a superplastic metal, then said deformation temperature is chosen to be higher than the super plastic temperature of the metal.

Preferably the process further includes applying axial compression at opposed axial ends of the tubular blank whilst simultaneously supplying said pressurised gas.

Preferably the axial compression is applied at said opposite axial ends by a pair of hydraulically powered pistons; the displacement and compressive force applied by the pistons being controllable.

Preferably the metal from which the component is formed is an aluminium or magnesium alloy. In such a case, the deformation temperature of said metal is preferably in the range of 400 to 600° C., more preferably is between 420–500° C.

For a 5000 and 6000 series aluminium alloy, the preferred temperature is about 450° C.

Preferably the process further includes the step of performing a subsequent hydroforming operation on ale deformed blank, the subsequent hydroforming operation being performed using a cold fluid, preferably a liquid, in order to deform the blank to the finished dimensions and shape of the component. Preferably the metal from which the tubular blank is made can be work hardened.

The subsequent hydroforming operation may be performed on the deformed blank in the same die immediately after deformation by the pressurised gas.

Alternatively, the subsequent hydroforming operation may be performed in a different die, the different die having the same or a different shape to the die in which the first fluidforming operation is performed.

Various aspects of the present invention are hereinafter describe with reference to the accompanying drawings, in which.

Figure 1:
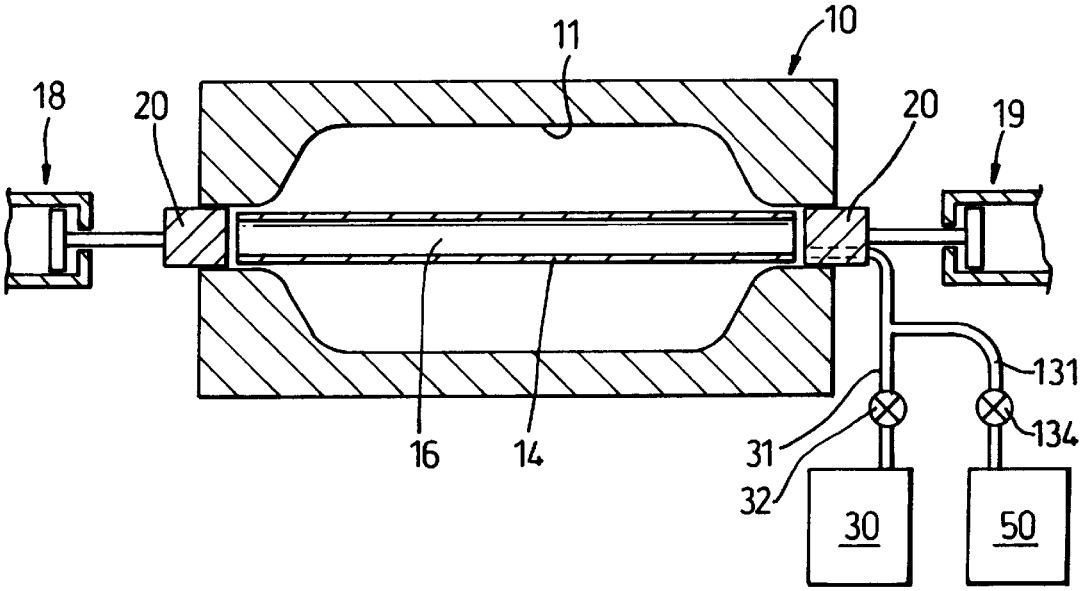
FIG. 1 is a diagrammatic representation of a first fluidforming operation in accordance with a process according to the present invention.

Referring to FIG. 1 there is shown a hydroforming die 10 having a cavity 11 of a desired shape. A tubular blank 14 of a suitable metal is located within the die 10.

The metal is preferably a drawing grade metal, ie. it exhibits the desirable yield and elongation characteristics for being drawn or stretched to a desired shape. A suitable metal is a 5000 or 6000 series aluminium alloy.

A pair of hydraulically powered pistons 18,19 are located at opposite axial ends of the tubular blank 14; each piston 18,19 having an abutment head 20 for abutment with the opposed axial ends of the blank 14.

Contact between abutment heads 20 and the axial ends of the blank 14 serve to sealing close the interior of the blank 14.

A source 30 of pressurised heated gas is provided. The source 30 communicates with the internal bore 16 of the tubular blank 14 via a conduit 31 which for example passes through the abutment head 20 of piston 19. Gas flow along conduit 31 is controlled for example by a valve 32.

Preferably the gas is air, but other suitable gases such as nitrogen, helium or argon may be used.

In operation, the tubular blank 14 is heated to a predetermined deformation temperature and the gas is supplied to the interior of the tubular blank at a pressure which is preferably less than about 85 bar when the metal is aluminium or magnesium alloy. The deformation temperature to which the tube is heated is chosen to be high enough to enable the pressure applied by the gas to cause deformation of the metal tubular blank. The gas pressure and temperature parameters are chosen such that a drawing or stretching deformation of the metal tubular blank occurs in a relatively short period of time preferably less than 5 minutes, typically less than about 2 minutes.

The upper limit of about 85 bar is chosen for safety reasons; it is envisaged therefore that higher gas pressures may be utilised, for example when the tubular blank is made from other metals such as steel.

The deformation temperature for aluminium or magnesium alloys is chosen to be between about 350° C. and less than the molten temperature. If the metal is a superplastic metal, the deformation temperature is preferably less than the plastic temperature of the metal from which the blank is formed.

In the case where the metal is an aluminium or magnesium alloy the deformation temperature of the metal is preferably chosen to be within the range of 400 to 600° C., preferably between 400 to 500° C., and more preferably between 420–500° C. For a 5000 or 6000 series aluminium alloy, the preferred deformation temperature is about 450° C.

The deformation pressure of the gas used in the case where the metal is an aluminium or magnesium alloy is preferably between 30 to 80 bar and is more preferably between 30 to 40 bar. For a 5000 or 6000 series aluminium alloy the preferred deformation pressure is about 35 bar.

In the case where the metal is a HSLA (i.e. High Strength Low Alloy) steel, the deformation temperature is chosen to be about 500–720° C. and the deformation pressure of the gas is preferably about 100 bar. For ferrite/pearlite steels, e.g. carbon manganese steels, the temperature is preferably 500–720° C. or above about 900° C.

Whilst the gas is supplied to the interior of the tubular blank 14 from source 30, pistons 18,19 are preferably actuated in order to apply a desired compressive force to the axial ends of the blank 14. The pistons 18,19 are controlled so as to provide the desired amount of compressive force and to also limit the displacement of the respective abutment heads 20 in the axial direction.

During the deformation operation brought about by the combined affect of the pressurised gas and the pistons 18,19 the metal blank is deformed radially outwardly by a drawing or stretching action and into contact with the surrounding walls of the die 10. The amount by which the pistons 18, 19 are displaced during the deforming process is controlled to ensure that sufficient metal flows in to the outwardly deforming regions to provide a desired amount of wall thickness. For example, the wall thickness may be maintained as substantially the same as that of the remainder of the tubular blank which has not undergone radial deformation ie. thinning of the wall thickness is prevented. If sufficient compressive force is applied by the pistons 18, 19 the wall thickness of the radially deformed regions may be increased relative to that which is not deformed.

On completion of this deforming operation, the gas supply is terminated from source 30.

An advantage with the process of the present invention is the ability to utilise the axial mechanical pressure applied by pistons 18, 19 to assist in radial deformation of the tubular blank 14 at central regions along the length of the tubular blank 14.

This is possible since the friction between the tubular blank 14 and die 10 is substantially reduced when using gas of the deforming pressure medium at the pressures defined by the present invention.

Figure 3:
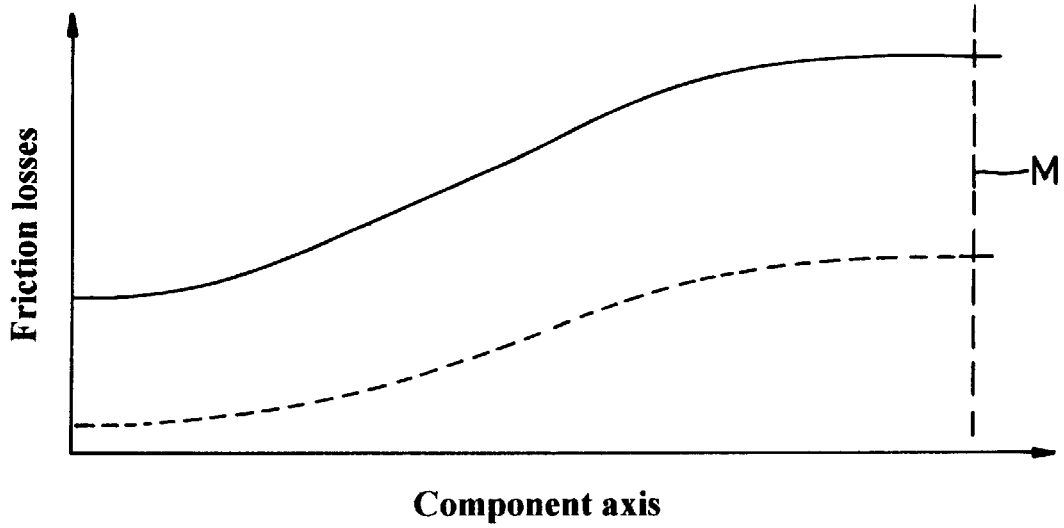
FIG. 3 shows two graphs, graph A and B comparing frictional losses and available material flow along a tubular component.
Figure 3:
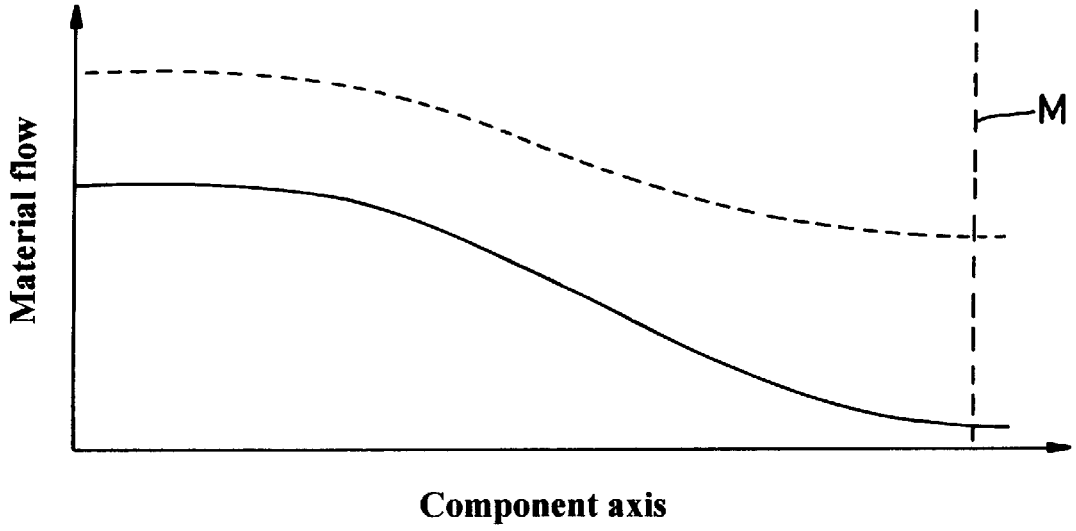

This is demonstrated schematically in graphs A and B in FIG. 3. In both graphs A and B the broken line represents a tubular blank being deformed in accordance with the present invention and the solid line represents a tubular blank being deformed in accordance with a conventional hydroforming process in which a liquid is used as the pressurised medium. With such processes the pressure of the liquid is typically 400–2000 bar and can be as high as 6000 bar.

A mid-point along the axis of the component is shown by vertical line M. In graph A, a plot of frictional loss against length along the component axis is shown.

As seen in graph A, frictional losses along the length of the tubular blank 14 are substantially higher in a conventional hydroforming process using liquid compared to frictional losses experienced with the process of the invention.

Graph B is a plot of material flow (which can be brought about by the applied axial compression of pistons 18, 19) against length along the component axis.

It will be seen that as a result of the frictional losses experienced in the conventional hydroforming process using liquid, there is substantially little or no material flow available at near to the mid-point M along the component whereas with the present invention there is a significant amount of material flow available.

This increase in the availability of material flow caused by axially applied forces enables greater radial deformation to be achieved with the process of the invention in the central regions of the tubular blank 14 compared to that possible with conventional hydroforming processes using liquid as the pressurising fluid.

Figure 4:
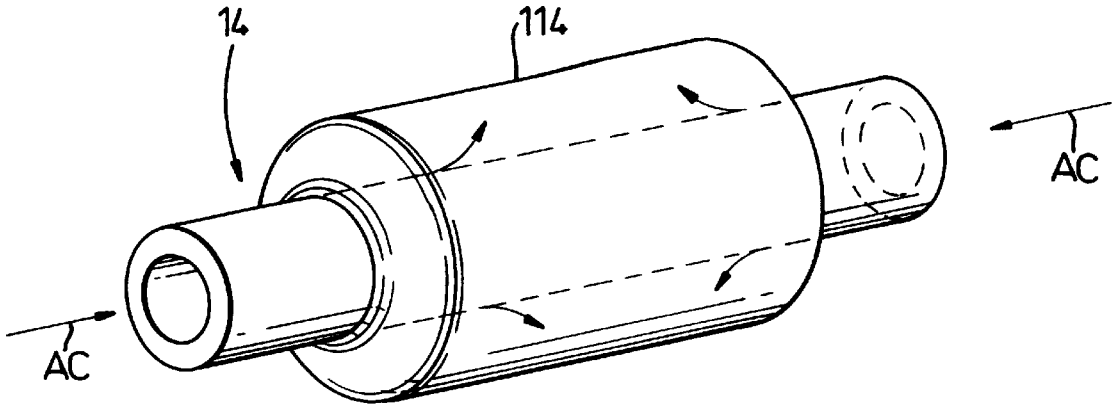
FIG. 4 is a diagrammatic perspective view of a tubular blank undergoing a fluidforming process according to the present invention.
Figure 5:
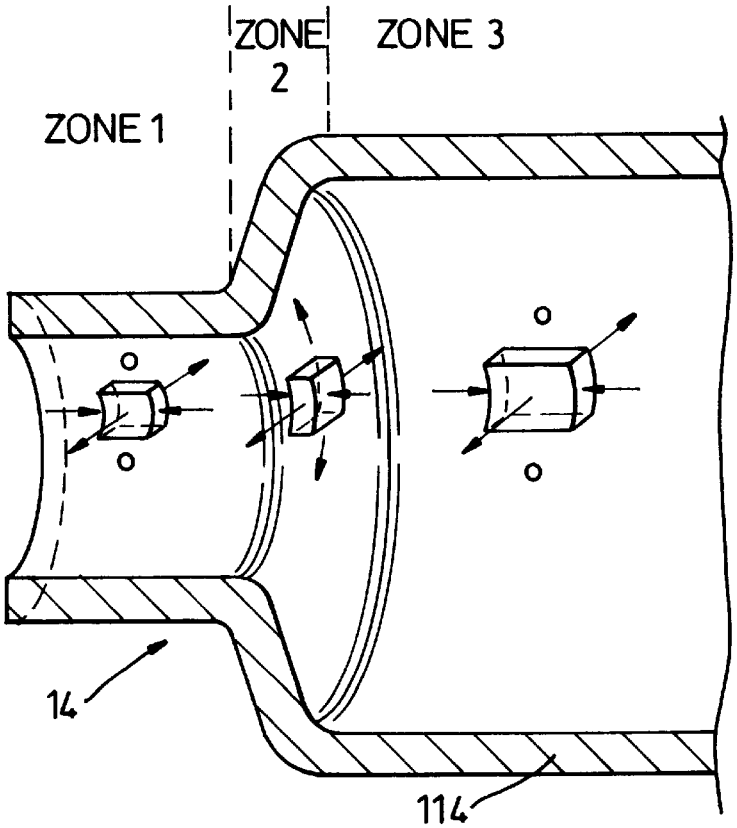
FIG. 5 is a diagrammatic sectional view of part of the tubular blank shown in FIG. 4.

Material flow during the drawing/stretching deformation of the tubular blank is diagrammatically illustrated in FIGS. 4 and 5.

In FIG. 4 axial compression is denoted by arrows AC and this together with the internally applied pressure from the pressurised gas causes the blank 14 to deform radially outwardly in region 114. This deformation causes the material to flow and will create thinning/thickening of the wall thickness of region 114 and the remainder of the blank 14.

In this respect, in Zone 1 the axial compression AC causes uniaxial compression and so potentially provides a wall thickening.

In Zone 2 the material undergoes circumferential stretch and radial feed of material brought about by the applied axial compression AC. This potentially creates material thinning.

In Zone 3 continued axial compression AC after the material has reached its radial extreme position potentially creates a material thickening.

Typically with a tube of a diameter about 70 mm and wall thickness between 2–5 mm the axial force applied by pistons 18, 19 is less than about 5 tons. This force is in excess of the countr axial force applied by the pressurised gas onto the pistons.

Since the deformation process has occurred at an elevated temperature it is possible that the deformed blank 114, which is now in a shape as determined by die 10, may shrink as it cools.

In accordance with the present invention, it is envisaged that a subsequent hydroforming operation may be performed in order that the cooled deformed blank 114 is further deformed to achieve the desired shape and dimensions of the finished component. This is diagrammatically shown in FIG. 2.

Figure 2:
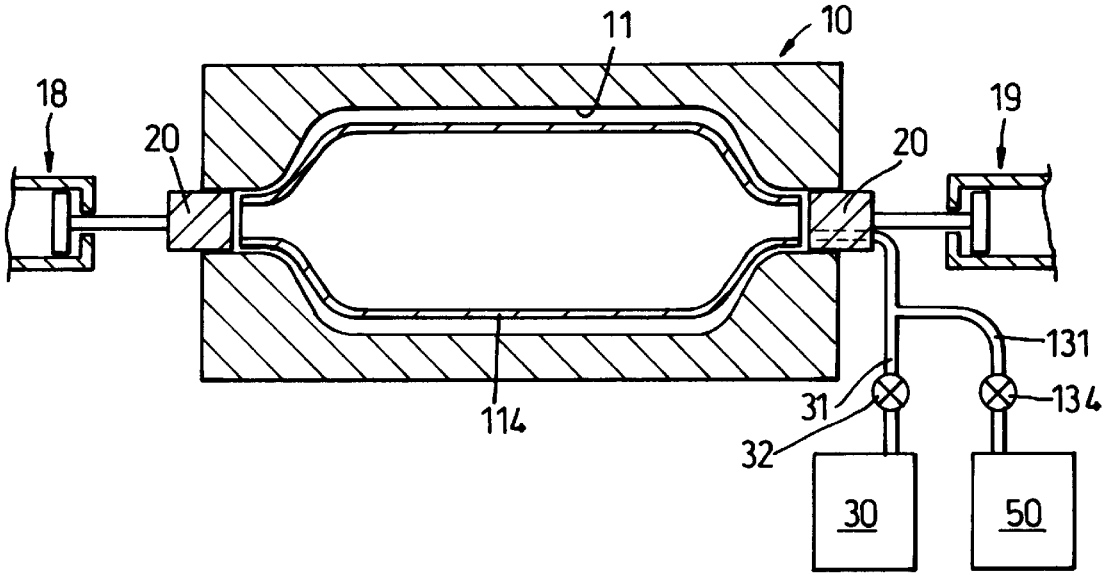
FIG. 2 is a diagrammatic representation of a subsequent hydroforming operation following the operation illustrated in FIG. 1.

In FIG. 2 it is assumed that the deformed blank 114 has shrunk on cooling and is still located within the die 10. A source 50 of a cold liquid is provided which communicates with the interior of the deformed blank 114 conveniently through a branch line 131 to conduit 31. A valve 134 is provided to control flow of liquid along branch line 131.

Cold liquid is supplied under pressure to the interior of the deformed blank 114 and so causes the deformed blank 114 to be cold formed into the desired shape and dimensions determined by the die 10. The temperature of the cold liquid is preferably between 10 to 80° C., and more preferably is about 20° C.

Prior to application of the cold liquid, the interior of the deformed blank 114 may be purged with a cooling fluid to cool the blank 114. However, the cold pressurised liquid may itself act, in part or solely, as the cooling fluid.

It is to be appreciated that the deformed blank may be removed from die 10 and inserted into a different die in which the subsequent hydroforming operation is performed. The different die may have the same or a different internal shape as the die 10.

The subsequent hydroforming operation may be used to effect hardening by cold forming of the deformed metal blank 114.

In this respect, the size of the die cavity in which the subsequent hydroforming operation occurs may be chosen to be larger in size than the deformed blank by a desired amount so as to ensure that the amount of elongation of the deformed blank 114 during the subsequent hydroforming operation is sufficiently large to achieve the desired amount of hardening by cold forming. Preferably, the amount of elongation undergone by the metal of the deformed blank 114 during the subsequent hydroforming operation is about 5 to 15%, more preferably about 10 to 15%.

The use of a gas at a low pressure in accordance with the present invention is advantageous in that the cycle time for the fluidforming process is relatively short. This arises since the pressurised gas has a low heat capacity and so the gas may be quickly heated and cooled. Thus the die can be opened for removal of the deformed blank after a shorter time period compared to processes using heated fluids having higher heat capacities such as liquids or fluidised solids.

In the embodiment described above, the pressurised gas may be heated to an elevated temperature and utilised to heat the tubular blank 14 up to the deformation temperature.

It is envisaged that the tubular blank 14 may be heated to its deformation temperature by heating means other than the pressurised gas.

For example, the die 10 may be heated, for example by an electric heater, or by heated fluid, so as to heat the tubular blank.

Alternatively the tubular blank 14 may be located in a die 10 having a cavity lined by an electrically and heat insulative material, such as ceramic, and be heated directly by heating means such as electrical is induction.

The use of an insulated die is advantageous as the die requires little or no cooling for performing the subsequent cold hydroforming operation.

The pressurised gas supplied to a tubular blank which is heated by the other means exemplified above may be supplied in a hot or cold condition. If supplied cold, the gas has little cooling effect on the heated tubular blank 14 due to the low heat capacity of the gas.

A further alternative is to generate the pressurised gas within the tubular blank. In this respect, it is envisaged that the blank 14 is heated to its deformation temperature within the die 10 and is sealed. Water is injected into the interior of the tubular blank 14 and generates steam. The amount of water injected into the interior of the tube 14 is chosen to be sufficient to generate steam of the desired deforming pressure.

What is claimed is:

1. A hydroforming process for forming a component from an elongate tubular blank comprised of a deformable metal, the process including placing the blank in a die and sealing opposed ends of the tubular blank, heating the blank to a predetermined deformation temperature which is greater than 350° C. but less than the melting point of the metal, supplying a gas at a predetermined pressure to the interior of the sealed tubular blank and applying axial compression at opposed axial ends of the tubular blank while simultaneously supplying said pressurized gas in order to cause deformation of said tubular blank within a deformation period of less than about 5 minutes at predetermined regions by drawing/stretching of the metal, and said deformation pressure of said gas being chosen so as to not significantly increase frictional losses between the tubular blank and the die so as to permit control of the wall thickness of the deformed regions by application of said axial compression.

2. A process according to claim 1 wherein the axial compression is sufficiently great to prevent thinning of the wall thickness of the deformed region.

3. A process according to claim 2 wherein the axial compression is sufficiently great to create a thickening of the wall thickness in said deformed region.

4. A process according to claim 1 wherein the metal from which the component is formed is an aluminium or magnesium alloy and the deforming temperature of said metal blank is preferably in the range of 400 to 600° C., more preferably is between 400 to 500° C.

5. A process according to claim 1 wherein the deformation pressure of said gas is chosen to be less than about 85 bar.

6. A process according to claim 1 wherein the metal from which the component is formed is steel and the deforming temperature of the metal blank is between 500–720° C.

7. A process according to claim 1 wherein the deformation pressure of said gas is less than about 100 bar.

8. A process according to claim 1 wherein the pressurised gas is air, nitrogen, argon or helium which is supplied to the metal blank from a remote pressurised source of said gas.

9. A process according to claim 1, wherein the pressurised gas is steam, the steam being generated by injecting water into a cavity defined by said metal blank when heated to said deforming temperature.

10. A process according to claim 1 wherein the metal is a super plastic metal and the deforming temperature is chosen to be outside the super plastic temperature of the metal.

11. A process according to claim 1 further including the step of performing a subsequent hydroforming operation on the deformed blank, the subsequent hydroforming operation being performed using a cold fluid in order to deform the blank to the finished dimensions and shape of the component.

12. A process according to claim 11 wherein the cold fluid is a liquid.

13. A process according to claim 11 wherein the subsequent hydroforming operation is performed on the deformed blank in the same die and immediately after deformation by the pressurised gas.

14. A process according to claim 11 wherein the subsequent hydroforming operation is performed in a different die to that in which deformation by said gas has occurred, the different die having the same or a different shape to the die in which the first hydroforming operation is performed.

15. A process according to claim 11 wherein the subsequent hydroforming operation is performed of the deformed blank so as to cause sufficient elongation to harden the metal by cold forming.

16. A process according to claim 15 wherein the amount of elongation is between 5 to 15%.

17. A hydroforming process for forming a component from an elongate tubular blank comprised of a deformable metal, the process including placing the blank in a die and sealing opposed ends of the tubular blank, heating the blank to a predetermined deformation temperature which is greater than 350° C. but less than the melting point of the metal, supplying a gas at a predetermined pressure to the interior of the sealed tubular blank to cause deformation of said tubular blank at predetermined regions by drawing/stretching of the metal, and wherein the pressurized gas is steam, the steam being generated by injecting water into a cavity defined by said metal blank when heated to said deforming temperature.

18. A process according to claim 17, further including the step of performing a subsequent hydroforming operation on the deformed blank, the subsequent hydroforming operation being performed using a cold fluid in order to deform the blank to the finished dimensions and shape of the component.

19. A process according to claim 18, wherein the cold fluid is a liquid.

20. A process according to claim 18 wherein the subsequent hydroforming operation is performed on the deformed blank in the same die and immediately after deformation by the pressurized gas.

21. A process according to claim 18, wherein the subsequent hydroforming operation is performed in a different die to that in which deformation by said gas has occurred, the different die having the same or a different shape to the die in which the first hydroforming operation is performed.

22. A process according to claim 18, wherein the subsequent hydroforming operation is performed of the deformed blank so as to cause sufficient elongation to harden the metal by cold forming.

23. A process according to claim 22, wherein the amount of elongation is between 5 to 15%.

* * * * *